US005533374A

United States Patent [19]

Seto et al.

[11] Patent Number: 5,533,374

[45] Date of Patent: Jul. 9, 1996

[54] EDGING ROLL FOR ROLLING SHAPE

[75] Inventors: Tsuneo Seto; Atsushi Hatanaka; Harumi Egeyama; Hironori Miura; Kazuo Ohmori, all of Okayama; Hirokazu Watari, Kobe, all of Japan

[73] Assignees: Kawasaki Steel Corporation; Kawasaki Jukogyo Kabushiki Kaisha, both of Kobe, Japan

[21] Appl. No.: 231,138

[22] Filed: Apr. 22, 1994

[30] Foreign Application Priority Data

Apr. 23, 1993 [JP] Japan ..... 5-097853
Nov. 30, 1993 [JP] Japan ..... 5-300661

[51] Int. Cl.[6] ..... B21B 27/02

[52] U.S. Cl. ..... 72/247; 72/252.5; 492/1

[58] Field of Search ..... 72/238, 239, 247, 72/224, 252.5; 492/1, 3, 16, 38, 39

[56] References Cited

U.S. PATENT DOCUMENTS 4,966,026 10/1990 Nishino ..... 72/366.2
5,031,435 7/1991 Seto et al. ..... 72/238
5,109,687 5/1992 Ooba et al. ..... 72/239

FOREIGN PATENT DOCUMENTS 62-77107 4/1987 Japan .
63-60008 3/1988 Japan .
63-199001 8/1988 Japan .
63-260610 10/1988 Japan .
63-303604 12/1988 Japan .
3-275202 12/1991 Japan .
3-281003 12/1991 Japan .
4-4908 1/1992 Japan .
4-4909 1/1992 Japan .
5-15909 1/1993 Japan .
5-23713 2/1993 Japan .
5-76912 3/1993 Japan .

*Primary Examiner*—Lowell A. Larson
*Assistant Examiner*—Thomas C. Schoeffler
*Attorney, Agent, or Firm*—Dvorak and Traub

[57] ABSTRACT

An edging roll for rolling a shape having a web and flanges, including a main shaft having an eccentric shaft portion; an eccentric sleeve having an eccentric portion facing the eccentric shaft portion of the main shaft; web-restricting rollers attached to the eccentric shaft portion of the main shaft and the eccentric portion of the eccentric sleeve through bearings; flange rolling rolls attached to the main shaft and the eccentric sleeve through bearings; a flange rolling roll drive means having a pair of gear transmission means, a connection shaft, and a rotation drive means; a roll height adjustment means for integrally rotating the main shaft and the eccentric sleeve; a roll-width adjustment means for synchronously and mutually moving the main shaft and the eccentric sleeve; and further a roll width/height adjustment synchronizing means and a pair of guide rings may also be disposed.

6 Claims, 10 Drawing Sheets

EDGING ROLL FOR ROLLING SHAPE

BACKGROUND OF THE INVENTION

1. Field of the Invention

The present invention relates to an edger rolling mill preferably disposed in a universal rolling facility for use to hot-roll a shape, such as an H-shape having a web and flanges, and formed by combining a universal rolling mill and an edger rolling mill.

2. Description of the Related Art

In general, when a shape, such as an H-shape having a web and flanges, is manufactured by continuous rolling, a raw material to be rolled to manufacture the shape, such as a bloom or a beam blank, has been rolled by a universal rolling facility which combines a universal rolling mill and an edger rolling mill. In this case, the edger rolling mill acts to roll the flanges of the H-shape to bring the flange width of the H-shape to a predetermined dimension. There is known in the prior art a type of the edger rolling mill which comprises a housing formed independently from the housing for the universal rolling mill and which has kaliber-type edging rolls for collectively restricting the web surfaces, the inside surfaces of the flanges and the end surfaces of the flanges of the raw material to be rolled.

There is known an attached-edger type rolling mill in Japanese Patent Laid-Open No. 63-303604. It has an arrangement wherein drum-type edger rolls are included in the housing of a universal rolling mill to restrict only the end surfaces of the flanges of a raw material to be rolled.

However, an edging rolling mill of the foregoing conventional type has a problem which will be discribed by making reference to the accompanying drawings.

Usually, the H-shape is manufactured in such a manner that a raw material to be rolled, such as a slab 71 or bloom 72 or a beam blank 73 obtained by continuous casting as shown in FIGS. 6A, 6B and 6C, is inserted into a heating furnace 80 shown in FIG. 7A so as to be heated to a predetermined level. Then, it is rolled to a rough form having a web and flanges by a rough rolling mill 81. A rough universal rolling mill 82 and an edger rolling mill 83 are used to reverse-roll the rough steel member several times. As an alternative to this, two roughing universal rolling mills 83 are disposed as shown in FIG. 7B and an edger rolling mill 83 is disposed between the two roughing universal rolling mills 82 to perform reverse rolling. As a result, the thicknesses of the web and flange portions of the raw material are gradually decreased as shown in FIGS. 8A and 8B so that the desired dimensions of the H-shape are realized. Then, a finish universal mill 84 is used to manufacture a final product as shown in FIG. 8C.

However, there has been a trend for the H-shapes for use in building or civil engineering to have various flange thicknesses and web thicknesses even if they have the same outer dimensions (constant web height and flange width) for efficiency in operation and economical advantage. If the foregoing edger rolling mill having the kaliber-type edging roll is used to perform edging-rolling in the aforesaid case, the size of the H-shape is fixed. Therefore, there arises a necessity when rolling H-shapes with fixed web heights How and flange widths Hf by the same rolling line by varying the web thickness tw and flange thickness tf shown in FIG. 9 to change the rolling rolls. This causes a problem in that a long time and much work is needed and the manufacturing yield considerably deteriorates because the rolling line must be stopped.

Since a body portion 91 of a kaliber-type edging roll 90 comes in contact with the flange portion hf and web portion hw of raw material h for manufacturing an H-shape as shown in FIG. 10, the peripheral speed of roll varies in corresponding regions. Therefore, a problem arises in that the raw material h has scratches on the surface thereof and another problem is that the rolls become worn in an excessively short time.

When the edges of an H-shape are rolled by using the drum-type edging roll disclosed in Japanese Patent Laid-Open No. 63-303604, edging rolling adaptable to the size of the shape to be rolled can be performed only by changing the interval of opening of the rolls even if the flange width is changed. However, the foregoing method has a structure wherein only the end surfaces of the flanges of the raw material are restricted, with the result that 10 guiding of the raw material to be rolled becomes unstable. In this case, there is a risk that the dimension (called a "flange depth" 1 shown in FIG. 9) from the web surface of the raw material to be rolled to the leading ends of the flanges of the same becomes different. What is worse, the risk of inclination of the flanges deteriorates the dimension accuracy.

As a result of research made to overcome the foregoing various problems experienced with the conventional technology for rolling shapes, there has been developed technology for manufacturing an H-shape with fixed outer dimensions, such as the fixed web height and flange width, by adjusting the inner dimensions of the web and the flange depth of the flange.

The foregoing technology is technology for rolling a shape by using an edging roll for rolling a shape and it is disclosed in Japanese Patent Laid-Open No. 62-77107, Japanese Patent Laid-Open No. 63-60008, Japanese Patent Laid-Open No. 63-199001, Japanese Patent Laid-Open No. 63-260610, Japanese Patent Laid-Open No. 3-275202, Japanese Patent Laid-Open No. 3-281003, Japanese Patent Laid-Open No. 4-4908, Japanese Patent Laid-Open No. 4-4909, Japanese Patent Laid-Open No. 5-15909, Japanese Patent Laid-Open No. 5-23713 and Japanese Patent Laid-Open No. 5-76912. In this prior art, an H-shape is rolled in such a manner that the end surfaces of the flanges of the raw material to be rolled are rolled by using the flange rolling rolls separately disposed on the main shaft in a state where the web and two-side corners of the flanges of the raw material to be rolled are restricted by using web-restricting rollers divided into two sections. The web-restricting rollers or the flange rolling rolls are disposed eccentrically from the axis of rotation of the main shaft. Furthermore, the pair of web-restricting rollers are vertically moved in a range of degree of the eccentricity so that height from the flange rolling rolls to the web-restricting rollers (that is, the height of the web-restricting rollers) is adjusted so as to be adaptable to the change in the flange depth of the H-shape. In addition, the divided web-restricting rollers and the flange rolling rolls are made to be movable mutually in the axial direction of the main shaft in order to adjust the roll interval between the rolls. As a result, the rolling process can be carried out in a manner dependent on change in the inner dimensions of the web.

The foregoing method is able to freely change the web thickness, flange thickness, flange width and the web height and the like. Size-free capability is realized. As a result, it aims to efficiently produce shapes having satisfactory functions and exhibiting excellent quality.

However, each of the structures disclosed in Japanese Patent Laid-Open No. 62-77107, Japanese Patent Laid-Open No. 63-60008, Japanese Patent Laid-Open No. 63-199001, Japanese Patent Laid-Open No. 63-260610, Japanese Patent Laid-Open No. 3-275202, Japanese Patent Laid-Open No. 3281003 and Japanese Patent Laid-Open No. 5-15909 involves an apparatus for rotating eccentric rings disposed between the two eccentric rings. Therefore, the two eccentric rings cannot be brought closer and, accordingly, the minimum distance between the web-restricting rings cannot be shortened satisfactorily.

Each of the structures disclosed in Japanese Patent Laid-Open No. 4-4908 and Japanese Patent Laid-Open No. 5-23713 employs a method of driving web-restricting rolls. Therefore, each encounters a problem that biting of the raw material by the edger rolling mill causes the web, which is intended not to be rolled, to be rolled undesirably.

Since the structure disclosed in Japanese Patent Laid-Open No. 4-4909 involves an arrangement wherein the right and left flange rolling rolls are rotated by individual drive sources, it is difficult to synchronize the two flange rolling rolls with each other and to positively transmit the rolling torque to the raw material.

Japanese Patent Laid-Open No. 5-76912 has a problem that an on-line adjustment cannot be performed.

The suggested edging roll for rolling a shape has a problem in that the inside bulging portions of bulgings B formed on both inside and the outside of the leading portion of the flange hf of H-shape h, during the rolling operation, comes in contact with the web-restricting roller 8 which is being rotated as shown in FIG. 11 and therefore it is cut (as represented by hatched section Bb shown in FIG. 11) and causes undesirable flying dust. Furthermore, the web-restricting roller 8 does not support the leading portion of the flange hf. Therefore, there is another unsolved problem in that the restricting force of the leading portion is too weak to prevent deterioration in the dimension accuracy, such as inclination of the flange.

Although the structures disclosed in Japanese Patent Laid-Open No. 63-60008, Japanese Patent Laid-Open No. 63-199001 and Japanese Patent Laid-Open No. 63-260610 have suggested an apparatus for eliminating the clearance on the inside of the flange, a problem arises in that the structure is too complicated.

Some of the suggested edging rolls for rolling a shape have an arrangement wherein both web-restricting rollers and flange rolling rolls are operated synchronously. If the height setting for the web-restricting rollers is adjusted to adjust the flange depth, the roll width between the web-restricting rollers is changed in synchronization with the adjustment. Therefore, the roll width must be corrected individually when the roller height is adjusted, causing the process to become too complicated. Furthermore, power for driving the roll-width adjustment portion is required in addition to the power for driving the roller-height adjusting portion. Therefore, there arises a problem of greater energy consumption required to drive the apparatus.

SUMMARY OF THE INVENTION

The present invention is directed to overcome the problems experienced with the structures of the prior art. Accordingly, a first object of the present invention is to provide an edging roll for rolling a shape capable of synchronizing the two flange rolling rolls with each other and of positively transmitting the rolling torque to the raw material, and of rolling so-called shapes with fixed outer dimensions having different web thicknesses and flange thicknesses but having fixed web height and flange width including shapes having very small web height without a necessity of performing a complicated operation such as change of rolling rolls.

Another object of the present invention is to provide an edging roll for rolling a shape capable of rolling any of shapes having various dimensions without a necessity of changing rolling rolls thereof, of adjusting the roll height without a necessity of performing a complicated operation such as correction of the roll width and exhibiting a satisfactory manufacturing yield.

A still further object of the present invention is to provide an edging roll for rolling a shape capable of rolling any shape having various dimensions without a necessity of changing rolling rolls; of preventing generation of inside bulging, dust generation and deterioration in the dimension accuracy and the like, which cannot be modified by finish rolling, with a very simple structure; and of efficiently manufacturing high quality products with a simple structure.

In order to achieve the foregoing objects, according to one aspect of the present invention, there is provided an edging roll for rolling a shape having a web and flanges, the edging roll for rolling a shape comprising:

a main shaft having a shaft portion in which its central axis coincides with a central axis of rotation and an eccentric shaft portion formed at substantially the central portion of the shaft portion and made to be eccentric with respect to the central axis of rotation;

an eccentric sleeve attached to surround either shaft portion of two shaft portions on both sides of the eccentric shaft portion of the main shaft to be slidable in an axial direction and having an eccentric portion facing the eccentric shaft portion of the main shaft; web-restricting rollers attached to the eccentric shaft portion of the main shaft and the eccentric portion of the eccentric sleeve through bearings and capable of restricting a web portion of a raw material to be rolled for forming the shape; flange rolling rolls attached to the main shaft and the eccentric sleeve through bearings to interpose the web-restricting rollers and arranged to roll the flanges to obtain the aimed flange width of the raw material to be rolled for forming the shape; a flange rolling roll drive means having a pair of gear transmission means each having a gear formed on an outer surfaces of a portion of each of the pair of flange rolling roll shafts and pinions arranged to engage with the gears and having the same gear ratio, a connection shaft for establishing the connection between the pair of pinions to transmit rotational torque from either pinion to the other pinion, and a rotation drive means for rotating either of the flange rolling rolls; a roll height adjustment means for integrally rotating the main shaft and the eccentric sleeve; and a roll-width adjustment means for synchronously and mutually moving the main shaft and the eccentric sleeve in an axial direction through rotations of a rotational thread shaft.

Other and further means of the invention will be appear more fully from the following description.

BRIEF DESCRIPTION OF THE DRAWINGS

FIG. 6 is a cross sectional view which illustrates a raw material to be rolled to manufacture an H-shape, in which

DESCRIPTION OF THE PREFERRED EMBODIMENT

Figure 1:
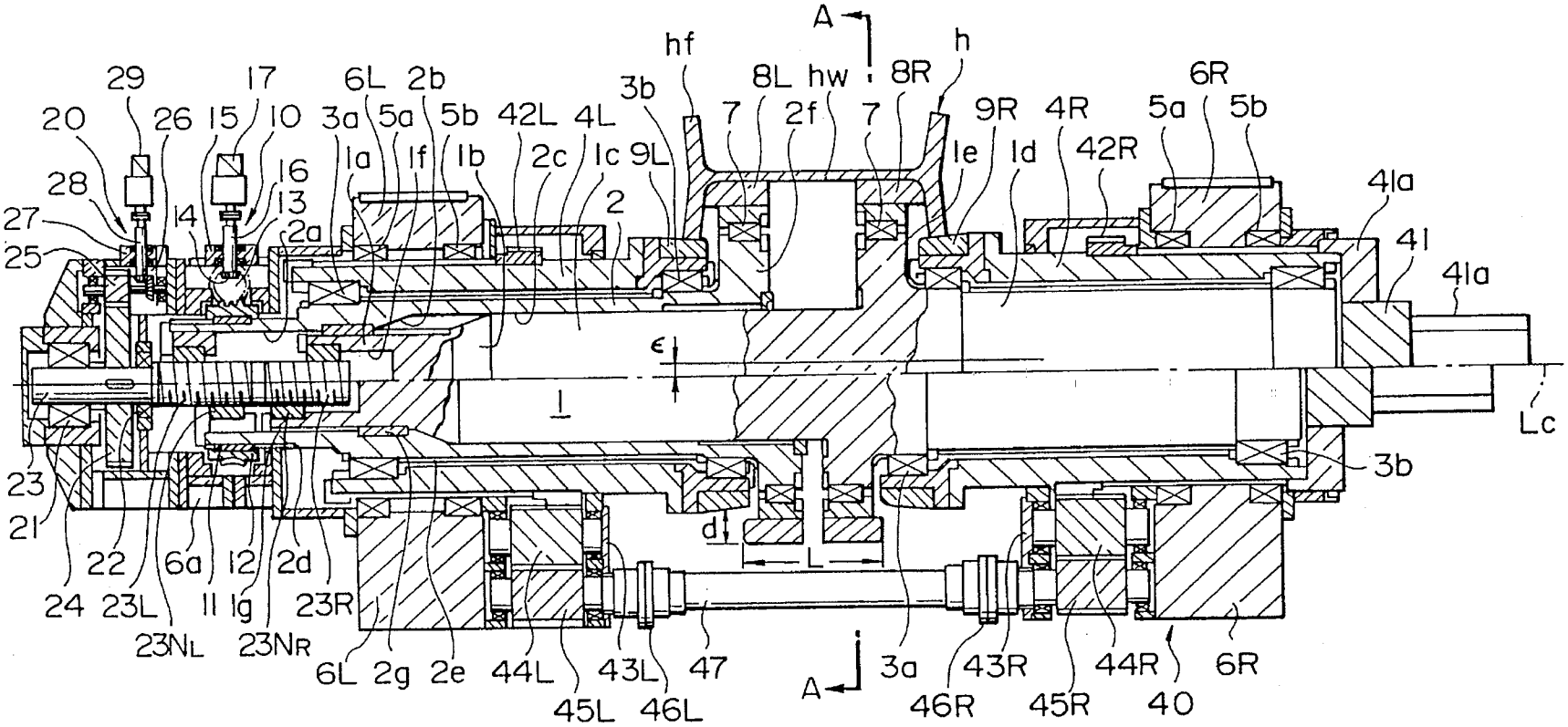
FIG. 1 is a cross sectional view which illustrates a first embodiment of the present invention showing different states of the roll width between the upper portion and lower portion thereof.

The edging roll for rolling a shape according to this invention is arranged so that the web-restricting rolls are rotatively supported by the eccentric shaft portion of the main shaft and the eccentric portion of the eccentric sleeve through bearings. Therefore, when the main shaft and the eccentric sleeve are rotated by the roll-height adjustment means, the roll height can be adjusted to be in a range which is twice the quantity of the eccentricity. As a result, the web-restricting rollers can positively be brought into contact with the web regardless of the web thickness of the raw material for forming a shape. When the rotational thread shaft is rotated by the roll-width adjustment means, the main shaft and the eccentric sleeve can mutually and synchronously be moved in the axial direction so as to positively bring the web-restricting rollers into contact with the inner surfaces of the flanges of the raw material to be rolled. In addition, the flange rolling rolls can positively be brought into contact with the end surfaces of the flanges. Furthermore, the gears respectively formed at a portion of the outer surfaces of the pair of flange rolling roll shafts and the gear transmission means having the pinions arranged to engage with the gears, are caused to have the same gear ratio. The pinions are connected to each other by the connection shaft. When either flange rolling roll is rotated by the rotation drive means, the pair of the flange rolling rolls can be synchronized with each other. As a result, the rolling torque can assuredly be transmitted to the raw material to be rolled.

The edging roll is arranged so that the main shaft and the eccentric sleeve are allowed to join together by means of a key so as to be slidable in the axial direction and to be fixed in the rotational direction. When the worm shaft is allowed to engage with the worm wheel secured to the eccentric. sleeve and is rotated by the rotation drive means, the eccentric sleeve and the main shaft can be rotated integrally. Therefore, the web-restricting rolls can continuously be contacted with the web of the raw material.

The edging roll is provided with nuts on the main shaft and on the eccentric roll to allow engagement with the male thread portion on the rotational thread shaft having threads formed in the reverse direction. Therefore, when the rotational thread shaft is rotated, for example, forwards, the main shaft and the eccentric sleeve can be moved outwards for the same distance. When the rotational thread shaft is rotated reversely, the main shaft and the eccentric sleeve can simultaneously be moved inwards on the same path. Therefore, the pair of web-restricting rolls can be moved for the same distance from the center of the rolling line.

The edging roll is arranged so that the roll width/height adjustment synchronizing means is used to synchronously operate the roll-width adjustment means in synchronization with the operation of the roll-height adjustment means when the roll height is adjusted. Therefore, change in the roll width can automatically be corrected. Furthermore, the synchronization with the roll-height adjustment means realized by the roll width/height adjustment synchronizing means is automatically suspended when the roll width is adjusted by the roll-width adjustment means. When the roll height and the roll width are simultaneously adjusted, the operation of the roll width/height adjustment synchronizing means corrects the quantity of the change in the roll width taking place due to the operation of the roll-height adjustment means. Furthermore, the degree of change in the roll width caused by the roll-width adjustment means is increased.

The edging roll is also arranged so that, when only the roll-height adjustment means is driven, its drive force rotates the eccentric sleeve together with the main shaft so that the adjustment of the height of the web-restricting rollers is commenced. Simultaneously, the synchronizing gear provided for the eccentric sleeve is rotated. The rotations of the synchronizing gear are transmitted, through the reverse gear, to cause the planetary ring of the roll width/height adjustment synchronizing means to be rotated; the planetary gear of the same to be rotated; and the roll-width adjustment gear to be rotated so as to rotate the rotational thread shaft in the same direction as the direction of the eccentric sleeve at the same speed. As a result, the axial-directional movements of the eccentric sleeve and the main shaft taking place due to the rotations of the eccentric sleeve through the rotational thread shaft are compensated. Therefore, the width-changing movement of the web-restricting rollers can be automatically corrected when the roll height is adjusted [can automatically be corrected]. When the roll-width adjustment means is driven, the drive force rotates the rotational thread shaft so as to commence the width adjustment of the web-restricting rollers and the flange rolling rolls. Simultaneously, the planetary gear of the roll width/height adjustment synchronizing means is rotated and revolved around the rotational thread shaft. If the roll-height adjustment means is stopped at this time, the planetary ring, which is one of the gears with which the planetary gear is allowed to engage, is restricted and its rotation is inhibited. As a result, the roll-width adjustment gear, which is another gear with which the planetary gear is allowed to engage and whose number of teeth is the same as that of the planetary ring, is rotated at speed which is twice the number of revolutions of the planetary gear. Thus, the rotational thread shaft is rotated so that the width adjustments of the web-restricting rollers and the flange rolling rolls are performed independently from the roll-height adjustment means. When the roll-height adjustment means and the roll-width adjustment means are simultaneously operated, the width change of the flange rolling rolls and the web-restricting rollers taking place due to the operation of the roll-height adjustment means are compensated and corrected by the roll width/height adjustment synchronizing means. Therefore, only the roll width is substantially changed by the operation of the roll-width adjustment means.

The edging roll is further arranged so that the pair of guide rings are attached to the rear side of the eccentric portion and that of the eccentric shaft portion in such a manner that the phases of the eccentricity are made to be the same. As a result, the gap between the web-restricting rollers and the flange rolling rolls is always covered by the guide rings even during the flange depth is being adjusted by the roll-height adjustment means. Thus, the same degree of biting of the raw material to be rolled can be maintained as that obtainable when a kaliber-type roll is used. In addition, inclination of the flange can be prevented. Furthermore, bulging of the inner end surfaces of the flanges can be prevented. By bringing the guide ring into contact with the side surface of the eccentric portion of the eccentric sleeve and the eccentric shaft portion, the deflection of the guide can be prevented. As a result, accuracy in the rolling operation can be improved.

Preferred embodiments of the present invention will now be described with reference to the drawings.

Figure 2:
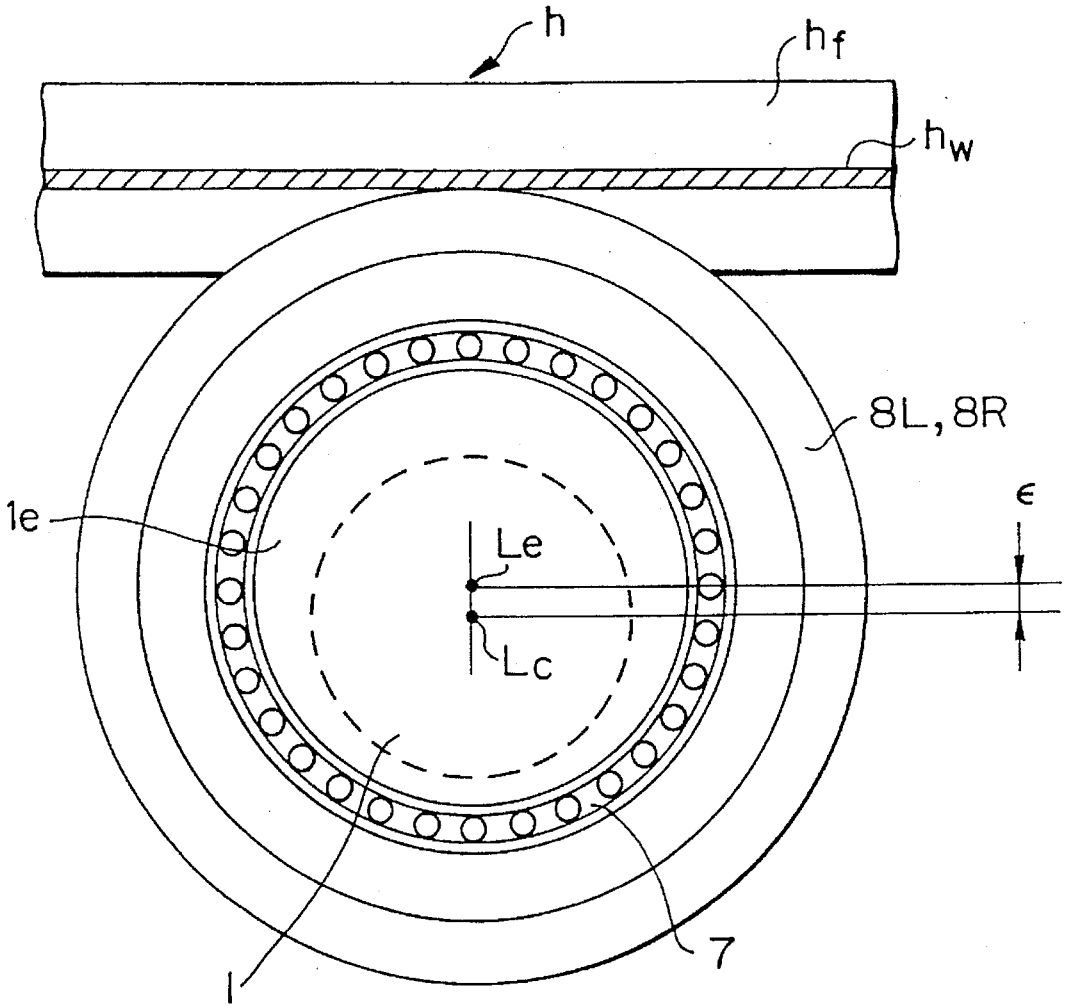
FIG. 2 is a cross sectional view taken along line A—A shown in FIG. 1.

FIG. 1 is a cross sectional view which illustrates a first embodiment of the present invention in a state where the axial-directional position is varied between the upper portion and the lower portion. FIG. 2 is a cross sectional view taken along line A—A shown in FIG. 1.

Referring to the drawings, reference numeral 1 represents a main shaft comprising: a small-diameter shaft portion 1*a* formed at the left end thereof; an intermediate-diameter shaft portion 1*c* formed adjacent to the small-diameter shaft portion 1*a* through a tapered portion 1*b* and having a diameter larger than that of the small-diameter shaft portion 1*a*; a large-diameter shaft portion 1*d* formed at the right end thereof and having a diameter larger than that of the intermediate-diameter shaft portion 1*c*; an eccentric shaft portion le made to be eccentric by eccentricity quantity $\epsilon$ with respect to a central axis Lc formed between the intermediate-diameter shaft portion 1*c* and the large-diameter shaft portion 1*d* and having a diameter larger than that of the large-diameter shaft portion 1*d*; and a recess if formed in the small-diameter shaft portion 1*a* by drilling from the left end surface.

A cylindrical eccentric sleeve 2, slidably in the axial direction, covers the outer surface of the left-half portion of the main shaft 1. The eccentric sleeve 2 has, on the inner surface thereof, a small-diameter hole portion 2*a*, a tapered portion 2*b* and an intermediate-diameter hole portion 2*c* corresponding to the small-diameter shaft portion 1*a*, the tapered portion 1*b* and the intermediate-diameter shaft portion 1*c* of the main shaft 1. Furthermore, the eccentric sleeve 2 has, on the outer surface thereof, an intermediate-diameter portion 2*d* and a large-diameter portion 2*e* having the same diameter as that of the large-diameter shaft portion 1*d* of the main shaft 1 in this sequential order when viewed from the left. In addition, the eccentric sleeve 2 has an eccentric portion 2*f* on the right end thereof, the eccentric portion 2*f* being formed to face the eccentric shaft portion 1*e* of the main shaft 1 and to have the same shape as that of the eccentric shaft portion 1*e*. A key 2*g* attached to the right end of the small-diameter hole portion 2*a* engages with a key groove 1*g* formed in the small-diameter shaft portion 1*a* of the main shaft 1 so that the eccentric sleeve 2 and the main shaft 1 are enabled to slide mutually and their relative rotations are inhibited when the eccentric axis of the eccentric portion 2*f* and that of the eccentric shaft portion 1*e* of the main shaft 1 coincide with each other.

In addition, flange-rolling-roll shafts 4R and 4L each having a cylindrical shape are rotatively disposed on the outer surface of the large-diameter shaft portion 1*d* of the main shaft 1 and that of the large-diameter portion 2*e* of the eccentric sleeve 2 through a pair consisting of right and left rolling bearings 3*a* and 3*b*.

Furthermore, roll chocks 6R and 6L to be included in a housing of a rolling mill (omitted from illustration) are disposed on the outer surfaces of the flange-rolling-roll shafts 4R and 4L through, for example, cylindrical roller bearings 5*a* and 5*b*.

In addition, a support cylinder 6*a* having a cylindrical shape is fixed to the left end surface of the left roll chock 6L.

Web-restricting rollers 8R and 8L are rotatively disposed on the outer surface of the eccentric shaft portion 1*e* of the main shaft 1 and the eccentric portion 2*f* of the eccentric sleeve 2 through, for example, cylindrical roller bearings 7. Similarly, flange-rolling rolls 9R and 9L, which are detachable, are fixed on the opposing sides of the flange-rolling-roll shafts 4R and 4L.

The main shaft 1 and the eccentric sleeve 2 are integrally rotated by a roll-height adjustment means 10 and as well as being mutually moved in the axial direction by a roll-width adjustment means 20.

The roll-height adjustment means 10 comprises a worm wheel 12 secured to the outer surface of the small-diameter portion 2*d* of the eccentric sleeve 2 by a key 11, a worm shaft 13 arranged to engage with the worm wheel 12 at an upper position, a drive shaft 16 connected to the worm shaft 13 through a bevel gear 14 and rotatively supported by the support cylinder 6*a* by means of a ball bearing 15 and a drive motor 17 secured to a fixed portion connected to the free end of the drive shaft 16.

The roll-width adjustment means 20 comprises a rotational thread shaft 23 being rotatively supported in the support cylinder 6*a* by a cylindrical roller bearing 21 and a ball bearing 22 and having, on its outer surface facing the recess 1*f* of the main shaft 1, a male thread portion 23R having a thread formed in, for example, a right-hand direction. The rotational thread shaft 23 further has, on its outer surface facing the small-diameter hole portion 2*a* of the eccentric sleeve 2, a male thread portion 23L having a thread formed in a left-hand direction. The roll-width adjustment means 20 further comprises a spur gear 24 secured to the rotational thread shaft 23, a pinion gear 25 arranged to engage with the spur gear 24 at an upper position, a drive shaft 28 connected to the pinion gear 25 through a bevel gear 26 and rotatively supported by the support cylinder 6*a* by means of, for example, a ball bearing 27, and a drive motor 29 connected to the free end of the drive shaft 28 and secured to the fixed portion.

Furthermore, the flange-rolling-roll shafts 4L and 4R are rotated by a flange-rolling-roll drive means 40. The flange-rolling-roll drive means 40 comprises a drive shaft 41 which is connected to the right portion of the right flange-rolling-roll shaft 4R and rotated by a drive motor (omitted from illustration) through an adapter 41*a* connected to the drive motor, outer-ring gears 42L and 42R secured to the outer surface of the two flange-rolling-roll shafts 4L and 4R at positions further inside than the roll chocks 6L and 6R, idle gears 44L and 44R which engage with the ring gears 42L and 42R at lower positions and rotatively supported by the roll chocks 6L and 6R and support members 43L and 43R connected to the roll chocks 6L and 6R, pinion gears 45L and 45R which engage with the idle gears 44L and 44R at lower positions and similarly rotatively supported by the roll chocks 6L and 6R and the support members 43L and 43R, and a connection shaft 47 disposed between the pair of pinion gears 45L and 45R and capable of transmitting rotational torque of the pinion gear 45R to the pinion gear 45L through joints 46L and 46R disposed on the two sides thereof.

The drive motors 17 and 29 of the roll-height adjustment means 10 and the roll-width adjustment means 20 are controlled by a process computer (omitted from illustration) to cause the web-restricting rollers 8L and 8R to positively restrict web hw and flanges hf in accordance with the web height How, web thickness tw, flange width Hf and the flange thickness tf of H-shape h (see FIG. 9) to be rolled.

The operation of this embodiment will now be described.

Figure 9:
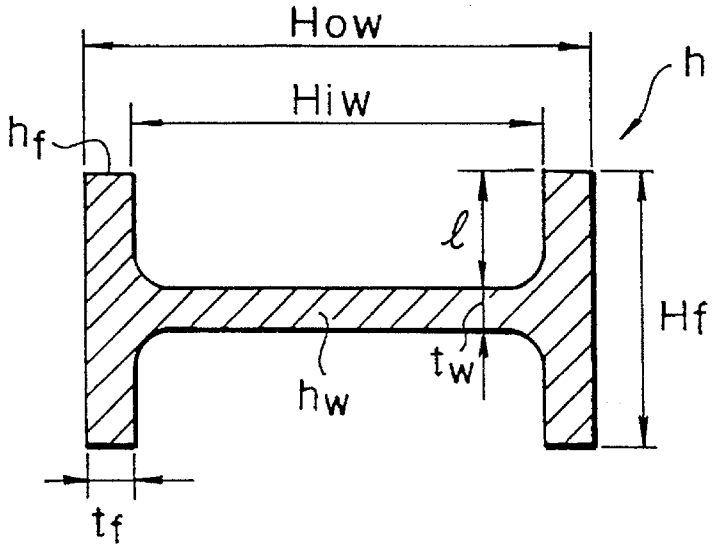
FIG. 9 is a cross sectional view which illustrates an H-shape.
Figure 10:
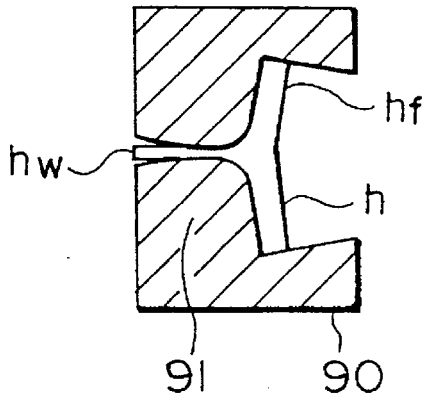
FIG. 10 PRIOR ART
FIG. 10 is a view which illustrates an example of a state in which a conventional kaliber-type edging roll is used to perform a rolling operation.
Figure 11:
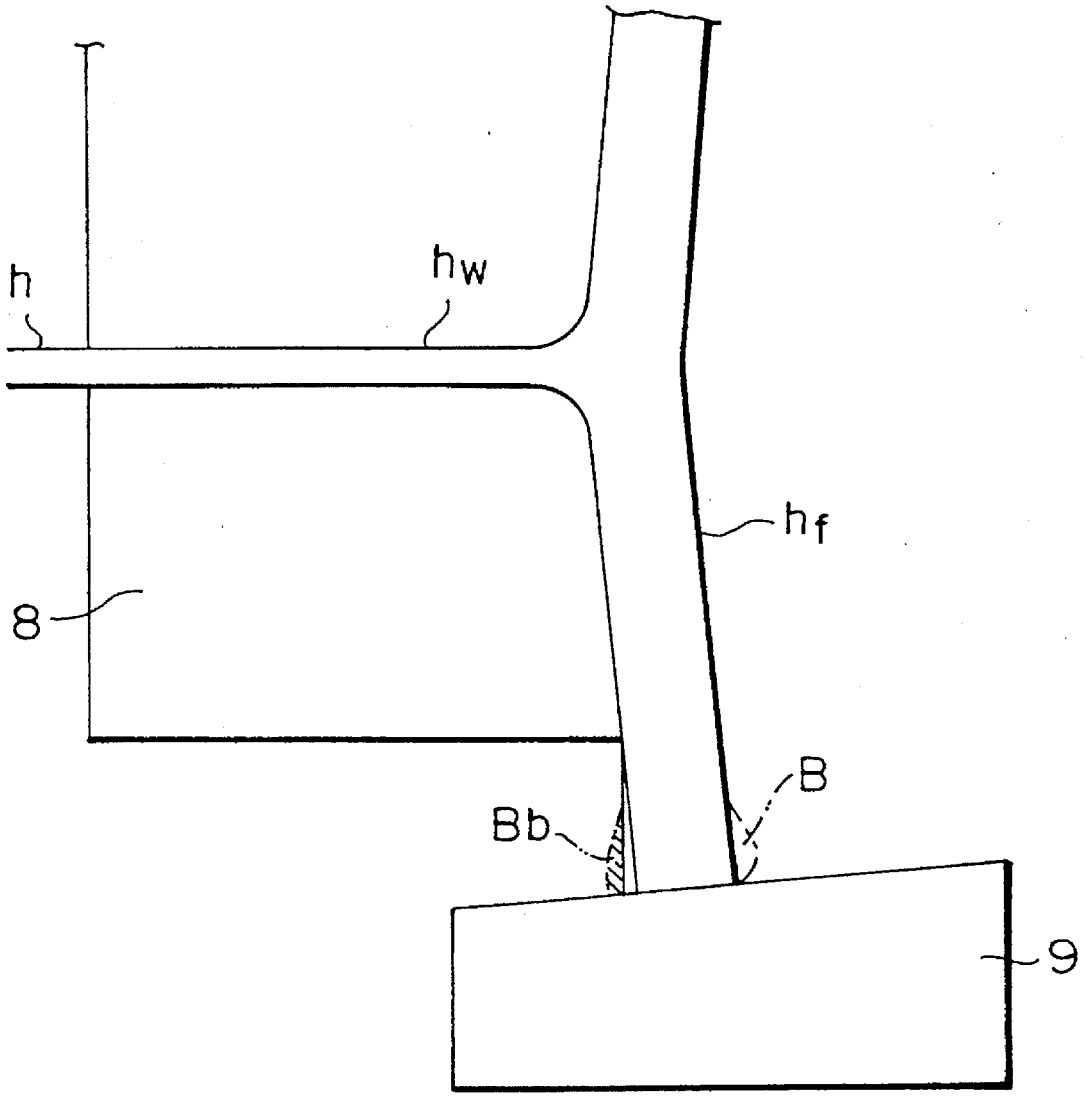
FIG. 11 PRIOR ART
FIG. 11 is a view which illustrates a state in which a bulging is cut by web-restricting rollers after flanges have been rolled.

If H-shape h shown in FIG. 9 has constant outer dimensions such that the height How of the web hw is, for example, 600 mm and the width Hf of the flange hf is, for example, 200 mm and is rolled, a case where the flange thickness tf varies in a range from 12 to 28 mm and the web thickness tw varies in a range from 6 to 12 mm will cause the inner dimension Hiw of the web to be a value obtained by subtracting twice the flange thickness tf from the web height How. Therefore, the inner width Hiw of the web varies in a range from 576 mm (which is 600 mm - 24 mm) to 544 mm (which is 600 mm - 56 mm). Since the quantity of the change in the web thickness is 6 mm, at least the eccentricity quantity $\in$ of both the eccentric shaft portion 1*e* of the main shaft 1 and the eccentric portion 2*f* of the eccentric sleeve 2 is set to be 1.5 mm, which is the quarter of the quantity of the change in the web thickness. Furthermore, the roll width L expressed by the distance between the right and left ends of the web-restricting rollers 8L and 8R is set such that it can be elongated/shortened from the maximum width 576 mm to the minimum width 544 mm. As a result, if H-shape h, the flange thickness of which is, for example, 12 mm and the web thickness of which is, for example, 6 mm, is rolled, the drive motor 17 of the roll-height adjustment means 10 is rotated as shown in the upper half portion of FIG. 1 so as to rotate the main shaft 1 and the eccentric sleeve 2 to a position at which eccentric axis Le coincides with a perpendicular surface which passes through a rotation axis Lc as shown in FIG. 2. Thus, at positions at which the web-restricting rollers 8L and 8R are positioned farthest from the rotation axis Lc of the main shaft 1, the web-restricting rollers 8L and 8R are brought into contact with the lower surface of the web hw of the H-shape h, when the lower surfaces of the flanges hf of the H shape are in contact with the flange rolling rolls 9L and 9R. Simultaneously, the drive motor 29 for the roll-width adjustment means 20 is rotated, for example, forwards to rotate the rotational shaft 23 forwards. As a result, the male thread portions 23L and 23R slide the main shaft 1 and the eccentric sleeve 2 in a direction in which the eccentric shaft portion 1*e* and the eccentric portion 2*f* move away from each other. Therefore, the outer surfaces of the web-restricting rollers 8L and 8R are brought into contact with the inner surfaces of the flange hf. It leads to a fact that H-shape h having thinnest web thickness tw and flange thickness tf can be rolled.

When the drive shaft 41 of the flange-rolling-roll drive means 40 is rotated in the foregoing state and its drive torque is therefore transmitted to the right flange-rolling-roll shaft 4R, the drive torque is transmitted to the left flange-rolling-roll shaft 4L through the ring gear 42R, the idle gear 44R, the pinion gear 45R, a joint 46R, the connection shaft 47, a joint 46L, the pinion gear 45L, the idle gear 44L and the ring gear 42L. As a result, the two flange-rolling-roll shafts 4L and 4R are synchronously rotated, causing rolling torque to be transmitted to the flanges hf because the flange-railing rolls 9L and 9R disposed at the ends of the flange-rolling-roll shafts 4L and 4R are in contact with the lower surface of the flanges hf of the H-shape h. Thus, the H-shape h is edging-rolled in such a manner that its web hw is restricted by the web-restricting rollers 8L and 8R.

If H-shape having thick web and flanges is rolled after the thin H-shape is rolled, the height set to the roll-height adjustment means 10 is shortened by the half of the increase in the web thickness by rotating the drive motor 17 to rotate the main shaft 1 and the eccentric sleeve 2. As a result, the height d between the web-restricting rollers 8L and 8R and the flange rolling rolls 9L and 9R is adjusted to an adequate value. The roll-width adjustment means 20 rotates the drive motor 29 in reverse to rotate the rotational thread shaft 23 in reverse. As a result, the eccentric shaft portion 1*e* and the eccentric portion 2*f* of the main shaft 1 and the eccentric sleeve 2 are brought closer by a distance corresponding to two times the increase in the flange thickness. Thus, the web-restricting rollers 8L and 8R can positively be brought into contact with the lower surface of the web hw and the inner surface of flanges.

The range of the roll heights which can be adjusted by the roll-height adjustment means 10 is twice the quantity of the eccentricity of the eccentric portion of both the main shaft 1 and the eccentric sleeve 2. The range of the roll widths which can be adjusted by the roll-width adjustment means 20 is made to be the lengths of the male thread portions 23L and 23R formed on the rotational thread shaft 23. Thus, the adjustment can continuously be performed within the foregoing adjustment ranges.

Figure 3:
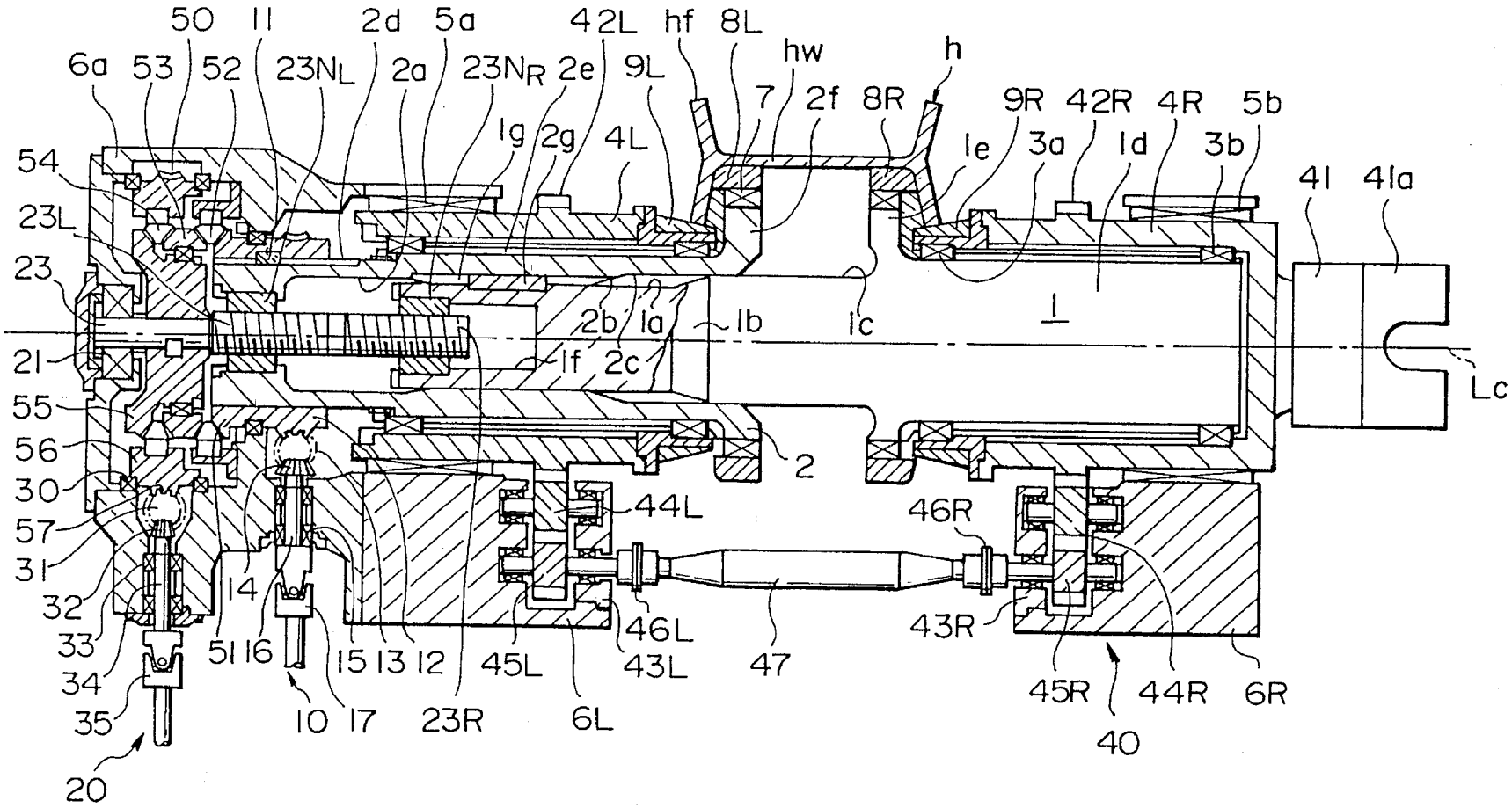
FIGS. 3 and 4 are cross sectional views which illustrate another embodiment of the present invention.

In the present invention, a roll width/height adjustment synchronizing means 50 for automatically correcting change in the roll width taking place when the roll-height adjustment means 10 is operated is further provided as shown in FIG. 3.

FIG. 3 illustrates a second embodiment wherein the roll width/height adjustment synchronizing means 40 is provided as an addition to the first embodiment. The same or equivalent elements to those according to the first embodiment shown in FIG. 1 are given the same reference numerals and their descriptions are omitted here.

The roll width/height adjustment synchronizing means 50 utilizes a synchronizing gear 51 integrally formed at an end portion of the worm wheel 12 of the roll-height adjustment means 10, a reverse gear 52 composed of a plurality of bevel gears allowed to engage with the synchronizing gear 51 and rotatively disposed on the inner surface of the support cylinder 6*a* through a bearing, an annular planetary ring 53 rotatively disposed on the outer surface of a roll-width adjustment gear 55 through a bearing 57 and having, on the two sides thereof, the same number of teeth as those of the synchronizing gear 51, the teeth on either side of which receive the reverse gear 52, a planetary gear 54 composed of a plurality of bevel gears allowed to engage with the gears on the residual side of the planetary ring 53 and rotatively disposed on the inner surface of a worm wheel 56 of the roll-width adjustment means 20 through a bearing, and a roll-width adjustment gear 55 having the same number of teeth as those of the synchronizing gear 51 on the outer surface thereof, and which engages the planetary gear 54 and is integrally-rotatively secured to the rotational shaft 23.

It should be noted that FIG. 3 illustrates a roll-width adjustment means 20 connected to the roll width/height adjustment synchronizing means 50 which is a different embodiment from the roll-width adjustment means 20 shown in FIG. 1.

That is, the second embodiment comprises a roll-width adjustment gear 55 for constituting the roll width/height adjustment synchronizing means 50, a planetary gear 54 composed of a plurality of bevel gears allowed to engage with the roll-width adjustment gear 55, a worm wheel 56 on the inner surface of which the planetary gear 55 is rotatively disposed, and which has a worm gear 57 on the outer surface thereof and which is rotatively supported on the inner surface of the support cylinder 6*a* through a ball bearing 30, a worm shaft 31 allowed to engage with the worm wheel 56, a drive shaft 34 connected to the worm shaft 31 through a bevel gear 32 and rotatively supported by the support cylinder 6*a* by means of, for example, a ball bearing 33, and a drive motor (omitted from illustration) connected to the free end of the drive shaft 34 through a universal joint 35. The rotational shaft 23 has, on its outer surface facing the recess 1*f* of the main shaft 1, a male thread portion 23R having a right-hand thread and, on its outer surface facing the small-diameter hole portion 2*a* of the eccentric sleeve 2, a male thread portion 23L having a left-hand thread. The rotational shaft 23 is allowed to engage with an end of the small-diameter shaft portion 1a of the main shaft 1 through a nut 23NR allowed to engage with the male thread portion 23R and as well as connected to an end of the small-diameter portion 2*a* of the sleeve 2 through a nut 23NL allowed to engage with the male thread portion 23L.

In the second embodiment, when the worm wheel 12 is rotated due to the activation of the roll-height adjustment means 10, the synchronizing gear 51 of the roll width/height adjustment synchronizing means 50 starts rotating integrally with its worm wheel 12. The rotation is transmitted to the planetary ring 53 through the reverse gear 52, causing the planetary ring 53 to be rotated at the same speed in a direction opposing the direction in which the synchronizing gear 51 is rotated. The rotation is transmitted to the roll-width adjustment gear 55 through the rotation of the planetary gear 54 (the revolution of the same is inhibited because the worm wheel 56 of the roll-width adjustment means 20 is stopped). As a result, the rotational thread shaft 23 is rotated at the same speed as the speed at which the synclonizing gear 51 is rotated and in the same direction as the direction in which the synchronizing gear 51 is rotated. Since the rotation of the rotational thread shaft 23 synchronizes with the rotations of the nuts 23NR and 23NL with which the male thread portions 23R and 23L of the rotational thread shaft 23 are allowed to engage, the axial-directional movement of the main shaft 1 and that of the eccentric sleeve 2 are compensated. As a result, the roll width L between the web-restricting rollers 8L and 8R is maintained at a constant value even in a period in which the roll-height adjustment operation is performed. Then, the drive motor for operating the roll-width adjustment means 20 is rotated, for example, forwards. The drive torque of the drive motor is transmitted to the worm wheel 56 through the universal joint 35, the drive shaft 34, the bevel gear 32 and the worm shaft 31 so that the worm wheel 56 is rotated forwards. It leads to a fact that the planetary gear 54 is revolved in the same direction as the direction in which the worm wheel 56 is rotated. If the roll-height adjustment means 10 is stopped at this time, the planetary ring 53 is also maintained at stoppage state. Therefore, the planetary gear 54 allowed to engage with the planetary ring 53 is rotated as well as revolved, resulting in that the roll-width adjustment gear 55 is rotated in the same direction as the direction in which the worm wheel 56 is rotated at a speed which is two times the speed of the rotations of the worm wheel 56. When the rotational shaft 23 is rotated due to the rotations of the roll-width adjustment gear 55, the male thread portions 23R and 23L having threads which are formed in the opposite directions are integrally rotated in the same direction. As a result, the nut 23NR allowed to engaged with the male thread portion 23R and the nut 23NL allowed to engage with the male thread portion 23L are moved in directions in which they move apart from each other in the axial direction. Thus, both main shaft 1 and the eccentric sleeve 2, to which the corresponding nuts 23NR and 23NL are secured, can be slid in a direction in which the eccentric shaft portion 1*e* and the eccentric portion 2*f* are moved apart (in directions in which the roll width L is enlarged). As a result, the outer surfaces of the web-restricting rollers 8L and 8R are brought into contact with the inner surfaces of the flanges hf.

Figure 4:
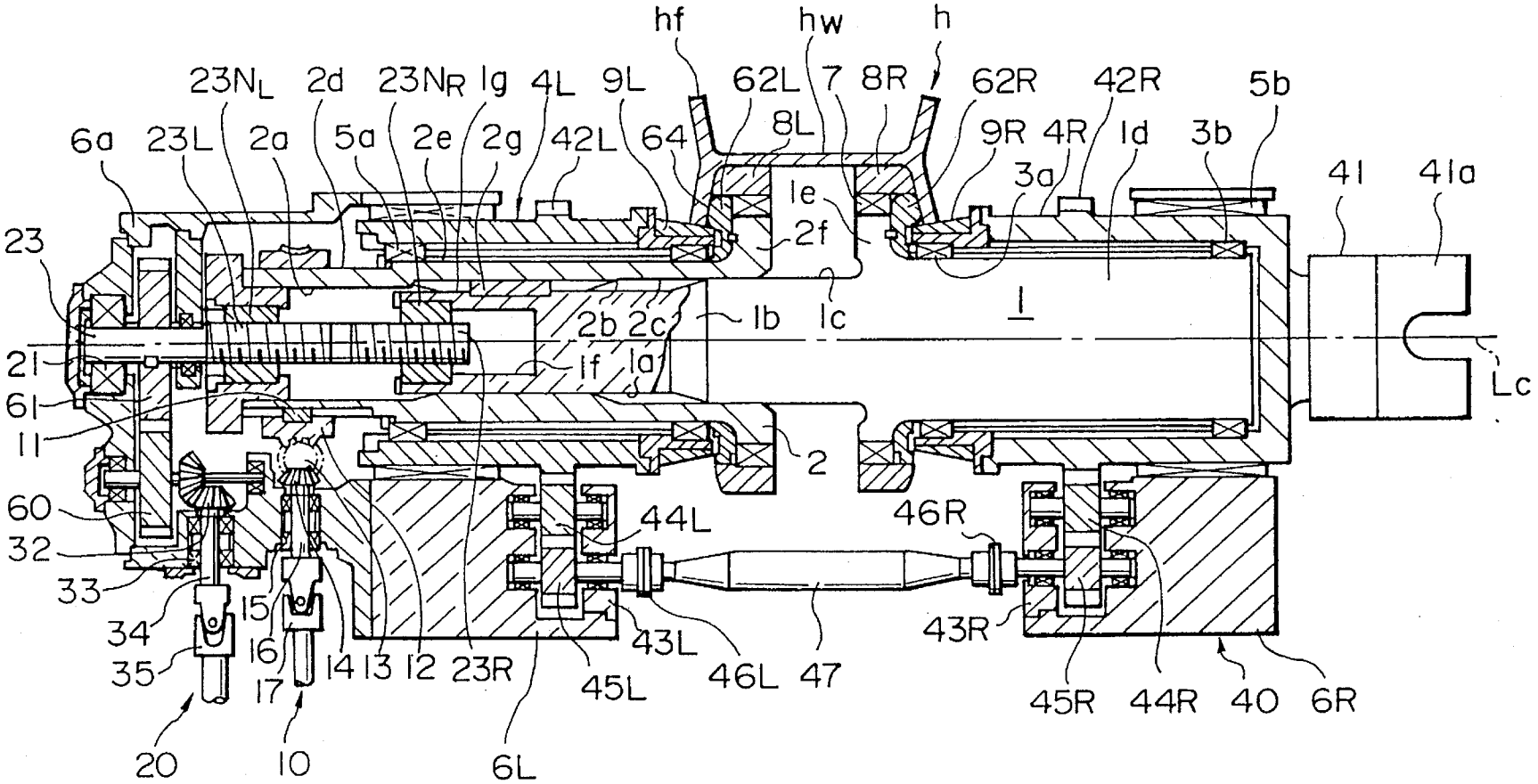
Figure 5:
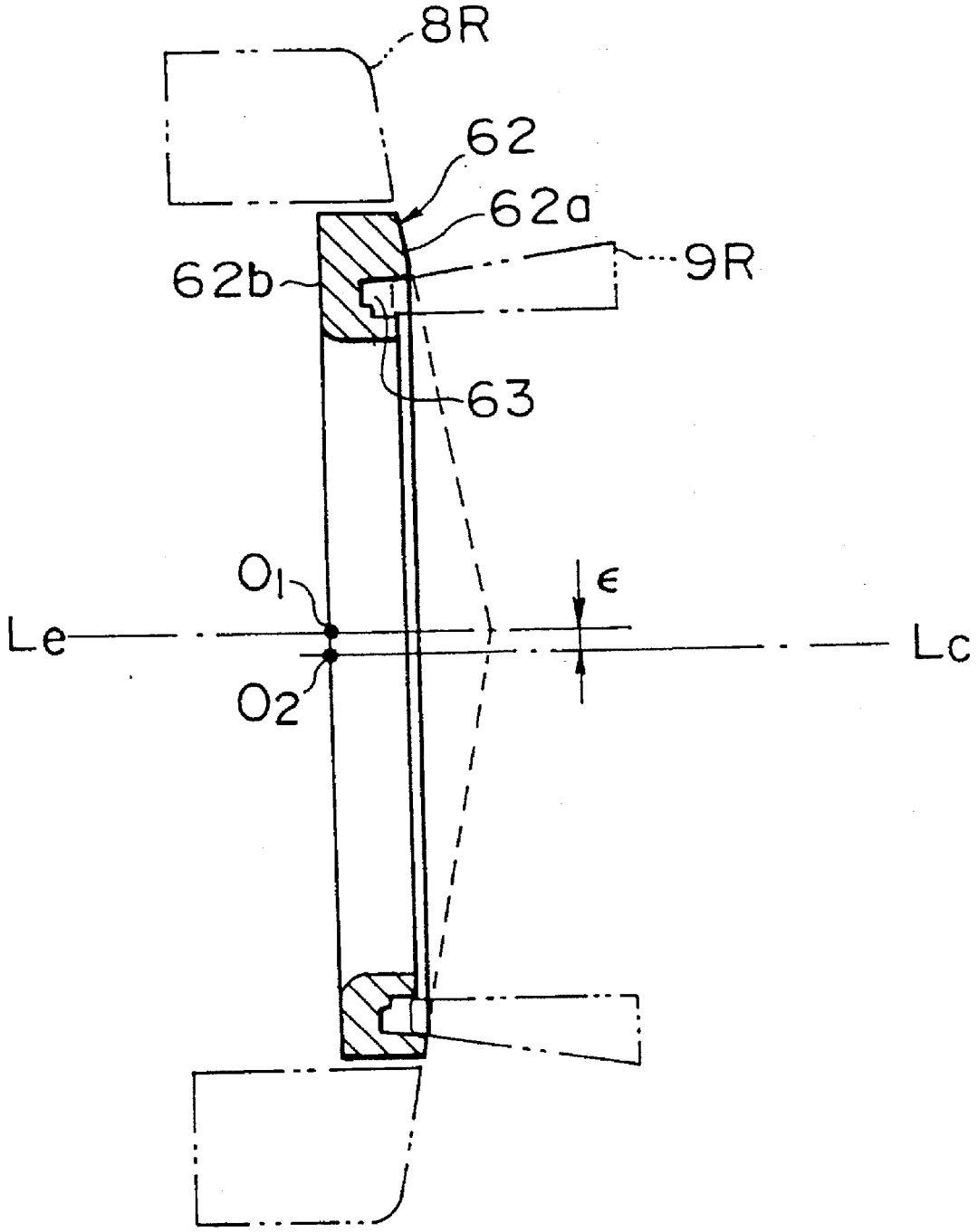
FIG. 5 is an enlarged cross sectional view which illustrates an essential portion of the embodiment shown in FIG. 4.
Figure 6A:
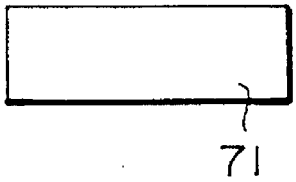
FIG. 6A illustrates a slab.
Figure 6B:
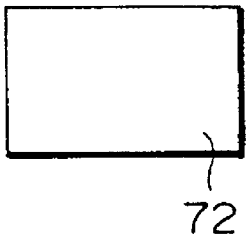
FIG. 6B illustrates a bloom and FIG. 6C illustrates a beam blank.
Figure 6C:
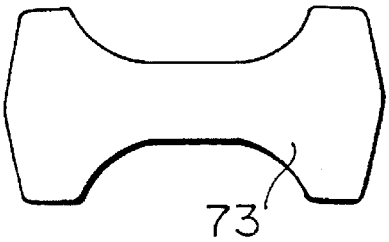
Figure 7A:
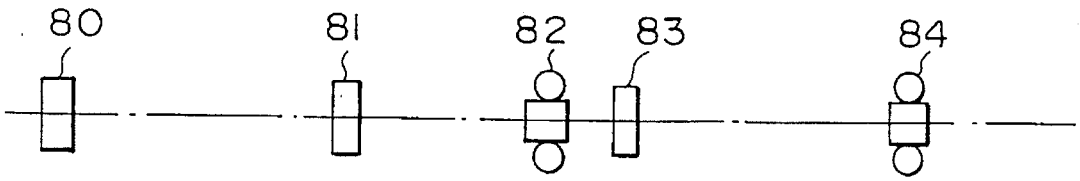
FIG. 7 is a view which illustrates an example of a line for rolling a shape.
Figure 7B:
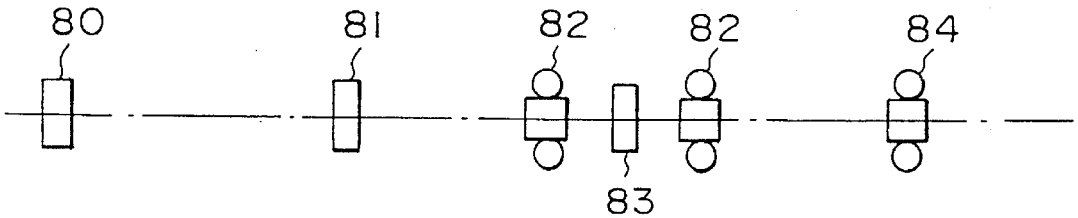
Figure 8A:
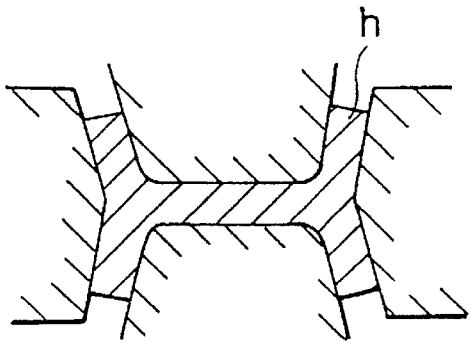
FIG. 8 is a view which illustrates a state in which an H-shape is rolled.
Figure 8B:
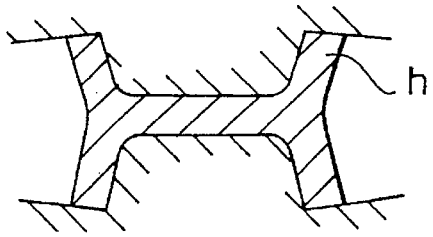
Figure 8C:
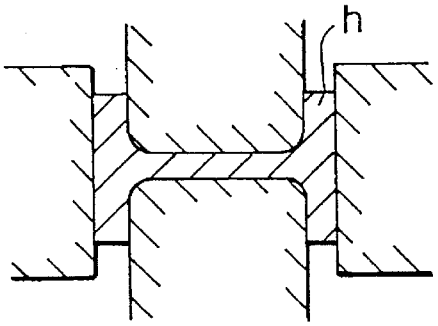

FIGS. 4 and 5 illustrate a third embodiment of the present invention.

The same or equivalent elements to those according to the first and second embodiments are given the same reference numerals and descriptions of the same elements are omitted here.

An edging roll for rolling a shape according to this embodiment is a type having no roll width/height adjustment synchronizing means 50 and having an arrangement that the rotational torque of the drive shaft 34 of the roll-width adjustment means 20 is transmitted to the rotational shaft 23 through a gear transmission means composed of two bevel gears 32 and spur gears 60 and 61.

Further, a guide ring 62 is secured to each of the back sides (that is, the opposing reverse sides) of the eccentric shaft portion 1*e* of the main shaft 1 and the eccentric portion 2*f* of the eccentric sleeve 2. Each guide ring 62 has an outer diameter which is somewhat smaller than the inner diameter of each of the web-restricting rollers 8L and 8R as shown in FIG. 5. The center $O_1$ of the outer diameter of the guide ring 62 coincides with the eccentric axis Le, which is the center of the web-restricting rollers. The inner diameter of the guide ring 62 has substantially the same dimension as the outer diameter of the main shaft 1 (or the eccentric sleeve 2). The center $O_2$ of the inner diameter of the guide ring 62 coincides with the rotation axis Lc which is the center of the flange-rolling rolls 9L and 9R. The eccentricity quantity $\in$ is provided between the two centers $O_1$ and $O_2$. A backside (the surface facing the inner surface of the flanges of raw material h to be rolled) 62*a* of the guide ring 62 has an inclined surface corresponding to the inclination of the flanges hf. Further, the guide ring 62 has recesses 63 at inside positions for receiving the leading portions of the flange rolling rolls 9L and 9R.

The guide ring 62L of the two guide rings 62 is allowed to engage with the outer surface of the eccentric sleeve 2. Further, a ring's front surface 62*b* of the guide ring 62L is positioned in contact with the backside of the eccentric portion 2*f* in a hermetic manner so as to be located and secured by a pin 64 in such a manner that the eccentricity and phase of the eccentric portion 2*f* are made to be the same. The other guide ring 62R is allowed to engage with the outer surface of the main shaft 1 and secured to the backside of the eccentric shaft portion 1*e* in such a manner that the eccentricity and phase of the eccentric shaft portion 1*e* are made to be the same.

When the guide rings 62 are mounted and the H-shape h is subjected to an edging process, gaps between the web-restricting rollers 8L and 8R and the flange rolling rolls 9L and 9R are always covered by the guide rings 62 including a period in which the roll height is adjusted by the operation of the roll-height adjustment means 10. Therefore, the restriction of the guide rings 62 prevents deflection and inclination of the flanges hf while maintaining a degree of biting of the material to be rolled similar to a case where a kaliber-type edging rolls are used. Furthermore, the deflection of the guide can be prevented and therefore the accuracy in rolling can be improved.

The guide rings 62 may, of course, be applied to an edging roll for rolling a shape equipped with the roll width/height adjustment synchronizing means 50 shown in FIG. 3, resulting in a similar effect.

The present invention is not limited to the structures of the roll-height adjustment means 10, web-restricting roll-width adjustment means 20, flange-rolling-roll drive means 40 and the roll width/height adjustment synchronizing means 50 according to each embodiment. Arbitrary structures may be employed.

Although the case where the H-shape is rolled is described in each embodiment, the shape to be rolled is not limited to this. The present invention may be applied to a case where another shape is rolled such as an I-shape or a chanel steel.

The roll-height adjustment means 10 is used to adjust the roller height and the roll-width adjustment means 20 is used to adjust the roll width so as to easily and accurately cope with change in the shape in an on-line manner if the web thickness and/or flange thickness of H-shape with fixed outer dimension is changed or if each H-shape has different web heights and flange widths. As a result, a necessity of changing the rolls can be eliminated. Since the rotation drive means having the connection shaft is provided, the two flange rolling rolls can be made to be synchronous with each other. Further, the rolling torque can assuredly be transmitted to the raw material. Furthermore, the roll width/height adjustment synchronizing means 50 eliminates a necessity of correcting the change in the roll width by operating the roll-width adjustment means 20 after the roll height has been adjusted by the roll-height adjustment means 10. Therefore, the process for adjusting the roll height can be simplified to improve the producibility and the required drive force can be reduced. Furthermore, since the guide ring is provided, bulging and the like can be prevented.

Although the invention has been described in its preferred form with a certain degree of particularly, it is understood that the present disclosure of the preferred form can be changed in the details of construction and the combination and arrangement of parts may be resorted to without departing from the spirit and the scope of the invention as hereinafter claimed.

What is claimed is:

1. An edge roll for rolling a shape steel having a web and flanges, comprising:

a main shaft having a small-diameter shaft portion and an intermediate-diameter shaft portion which are formed at one side of a substantially axially-central portion of said shaft, a large-diameter shaft portion formed at an opposite side of said substantially axially-central portion, and an eccentric shaft portion formed at said substantially axially-central portion such that said eccentric shaft portion 15 eccentric with respect to a central axis of said shaft, said eccentric shaft portion having a diameter greater than that of said large-diameter shaft portion;

an eccentric sleeve axially and circumferentially slidably fitting on said small and intermediate diameter shaft portions of said main shaft, said eccentric sleeve having at one end an eccentric portion opposing said eccentric shaft portion of said main shaft and having the same configuration as said eccentric shaft portion;

a pair of web-restricting rollers carried by outer peripheral surfaces of said main shaft and said eccentric portion of said eccentric sleeve through respective bearings and arranged to restrict a web portion of a raw material;

a pair of flange rolling rolls carried by the outer peripheral surfaces of said main shaft and said eccentric sleeve through respective bearings and arranged to interpose said web-restricting rollers therebetween so as to roll a flange portion of said raw material;

a flange rolling roll drive means having a pair of gear transmission means each having a gear provided on a portion of each of a pair of flange rolling roll shafts and a pinion engaging with said gear, said pair of gear transmission means having the same gear ratio, a connection shaft for establishing a connection between said pair of pinions to transmit rotational torque from either pinion to the other pinion, and a rotation drive means for rotating either of said flange rolling rolls;

a roll height adjustment means for integrally rotating said main shaft and said eccentric sleeve; and a roll-width adjustment means for synchronously moving said main shaft and said eccentric sleeve relative to each other in an axial direction through rotation of a rotational threaded shaft.

2. An edging roll for rolling a shape according to claim 1, wherein said roll-height adjustment means is comprised of a key for joining said main shaft and said eccentric sleeve, and a worm wheel integrally-rotatively attached by a key on an outer surface of said eccentric sleeve to rotate a worm shaft engaging said worm wheel by a rotation drive means thereon.

3. An edging roll for rolling a shape according to claim 1, wherein said roll-width adjustment means is comprised of a rotational thread shaft which is rotated through a second gear transmission means, and is disposed adjacent to an end of said main shaft and said eccentric sleeve, an end of said rotational thread shaft being inserted into an end of said main shaft and said eccentric sleeve to oppose said main shaft and said eccentric sleeve, male thread portions having threads operated in reverse directions on said two opposing portions, and said main shaft and said eccentric sleeve being connected to said rotational thread shaft through nuts engaging said male thread portions.

4. An edging roll for rolling a shape according to claim 1 further comprising a roll width/height adjustment synchronizing means for synchronously and mutually moving said main shaft and said eccentric sleeve in an axial direction in synchronization with said roll-height adjustment means.

5. An edging roll for rolling a shape according to claim 4, wherein said roll width/height adjustment synchronizing means is comprised of a roll-width adjustment gear disposed integrally-rotatively with said rotational thread shaft of said roll-width adjustment means and a planetary gear engaging said roll-width adjustment gear and arranged to revolve in synchronization with a widening and narrowing operation by said roll-width adjustment means, a planetary ring engaging said planetary gear, said planetary gear disposed to oppose said roll-width adjustment gear and being individually rotatable; and a synchronizing gear engaging said planetary ring through a reverse gear and arranged to rotate in synchronization with said eccentric sleeve when said roll-height adjustment means is operated.

6. An edging roll for rolling a shape according to claim 1 further comprising a pair of guide rings each being concentric to a web-restricting roller and having an inner diameter which is concentric with a flange rolling roll and an outer diameter which is substantially equivalent to an outer diameter of said main shaft and said eccentric sleeve, each of said rings being secured to said eccentric portion of said eccentric sleeve and said eccentric shaft portion, wherein phases of eccentricity of said eccentric sleeve and said eccentric shaft portion are in synchronization when rotating.

* * * * *

UNITED STATES PATENT AND TRADEMARK OFFICE

CERTIFICATE OF CORRECTION

PATENT NO. : 5,533,374

DATED : July 9, 1996

INVENTOR(S) : Seto, Tsuneo, et al

It is certified that error appears in the above-indentified patent and that said Letters Patent is hereby corrected as shown below:

Column 13,

*In Claim 1, Line 10, after the word "portion", please delete "15"*

*and insert --is--.*

Signed and Sealed this

Fifth Day of November, 1996

Bruce Lehman

*Attest:*

BRUCE LEHMAN

*Attesting Officer*

*Commissioner of Patents and Trademarks*